US011077870B2

(12) United States Patent
Li et al.

(10) Patent No.: US 11,077,870 B2
(45) Date of Patent: Aug. 3, 2021

(54) SIDE SLIDING DOOR OF RAILWAY VEHICLE

(71) Applicant: CRRC QINGDAO SIFANG CO., LTD., Shandong (CN)

(72) Inventors: Shanfei Li, Shandong (CN); Wenbiao Li, Shandong (CN); Jiao Wang, Shandong (CN); Hong Li, Shandong (CN); Sansan Ding, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 300 days.

(21) Appl. No.: 16/305,261

(22) PCT Filed: May 10, 2017

(86) PCT No.: PCT/CN2017/083699

§ 371 (c)(1),
(2) Date: Nov. 28, 2018

(87) PCT Pub. No.: WO2018/006647

PCT Pub. Date: Jan. 11, 2018

(65) Prior Publication Data

US 2020/0180664 A1 Jun. 11, 2020

(30) Foreign Application Priority Data

Jul. 4, 2016 (CN) ..... 201610518767.2

(51) Int. Cl.
*B61D 19/00* (2006.01)
*B61D 19/02* (2006.01)
(Continued)

(52) U.S. Cl.
CPC ..... *B61D 19/005* (2013.01); *B61D 19/026* (2013.01); *E05D 15/0621* (2013.01); *E05D 15/1044* (2013.01); *E05Y 2900/51* (2013.01)

(58) Field of Classification Search
CPC ..... E05D 2015/1071; E05D 2015/1084; E05F 15/565; E05F 15/56; E05F 15/632; B61D 119/008; B61D 19/00
See application file for complete search history.

(56) References Cited

U.S. PATENT DOCUMENTS 4,697,384 A * 10/1987 Tutikawa ..... E05D 15/1042 49/127
6,497,072 B2 * 12/2002 Fries ..... E05B 65/08 49/146

(Continued)

FOREIGN PATENT DOCUMENTS

CN 201198313 Y 2/2009
CN 201272355 Y 7/2009

(Continued)

OTHER PUBLICATIONS

WO 2012/171279 (English translation) (Year: 2012).*

(Continued)

*Primary Examiner* — Mark T Le
(74) *Attorney, Agent, or Firm* — Buchanan Ingersoll & Rooney PC

(57) ABSTRACT

A side sliding door of a railway vehicle comprises a door body (100), and a driving device for the opening and closing of a doorway. An outer surface of the door body (100) is flush with an outer surface of the vehicle body when the door body (100) is closed. A movement track of the door body is arranged as an arc-plus-linear reciprocating motion. The outer surface of the door body is flush with the outer surface of the vehicle body when the door body is closed, so that there exists no height difference between the vehicle body and a doorway of the side sliding door. Snow accumulation at doorway under an extreme cold working condition is avoided, and then the risk of a door body being frozen is reduced.

11 Claims, 3 Drawing Sheets

(51) Int. Cl.
*E05D 15/06* (2006.01)
*E05D 15/10* (2006.01)

(56) References Cited

U.S. PATENT DOCUMENTS 8,375,645 B2 * 2/2013 Iwauchi ..... E05D 15/1042
52/29
8,984,810 B2 * 3/2015 Bortoluzzi ..... E05D 15/0678
49/213

FOREIGN PATENT DOCUMENTS

| | | | | |
|---|---|---|---|---|
| CN | 202000841 | U | | 10/2011 |
| CN | 102303618 | A | | 1/2012 |
| CN | 106014061 | A | | 10/2016 |
| CN | 206053668 | U | | 3/2017 |
| DE | 696812 | | * | 9/1940 |
| JP | 3645102 | B2 | | 2/2005 |
| WO | WO 2012/171279 | | * | 12/2020 |

OTHER PUBLICATIONS

International Search Report (PCT/ISA/210) dated Aug. 1, 2017, by the State Intellectual Property Office of the P.R. China as the International Searching Authority for International Application No. PCT/CN2017/083699.
Written Opinion (PCT/ISA/237) dated Aug. 1, 2017, by the State Intellectual Property Office of the P.R. China as the International Searching Authority for International Application No. PCT/CN2017/083699.

* cited by examiner

SIDE SLIDING DOOR OF RAILWAY VEHICLE

TECHNICAL FIELD

The present disclosure relates to a side sliding door, particularly relates to the side sliding door of a railway vehicle.

BACKGROUND

With the development of China's social economy and the acceleration of pace of people's life, the importance of rail transit in urban transportation is increased. The launching and running of the railway vehicle with higher speed has greatly increased capacity of rail transit. At the same time, the requirements for safety and comfort of the railway vehicle are also getting higher and higher. Among current railway vehicle, a side sliding door is highly favored in the railway vehicle industry due to its good safety and operational stability.

Current CRH2 and 380A/AL D-series high-speed trains are provided with a built-in side sliding door. Due to their own design structure, there exists a height difference between the doorway of the side sliding door and the vehicle body. When running in low temperature, rain and snow weather, the vehicle door has a hidden danger that the door body is frozen by snow. It cannot meet the operation conditions of the vehicle under extreme cold working conditions.

SUMMARY

The main object of the present disclosure is to solve the technical problems that the door body of the current side sliding door is easy to be frozen under an extreme cold working condition, a side sliding door of a railway vehicle is provided to solve the above technical problem.

In order to achieve the above object, the specific technical scheme is as follows:

A side sliding door of a railway vehicle comprises a door body and a driving device for the opening and closing of a doorway. Wherein, an outer surface of the door body is flush with an outer surface of a vehicle body when the door body is closed. A movement track of the door body is arranged as an arc-plus-linear reciprocating motion.

Based on the above scheme, there exists no height difference between the vehicle body and the doorway of the side sliding door. Snow accumulation at the doorway under extreme cold working condition is avoided, and then the risk of a door body being frozen is reduced.

Further, the door body is provided with an outward convex portion extending towards the outside of the vehicle. The length of an outer surface of the outward convex portion along a longitudinal direction of the vehicle is shorter than the length of an inner surface of the door body along the longitudinal direction of the vehicle.

Further, the door body and the outward convex portion form a stepped structure. A side surface of the door body is a combination of an inclined surface, a flat surface and an inclined surface.

Further, a vehicle body door frame is arranged around the periphery of the door body. The length of an outer surface of the vehicle body door frame along the longitudinal direction of the vehicle is longer than the length of an inner surface of the vehicle body door frame along the longitudinal direction of the vehicle.

Further, a side surface of the vehicle body door frame is arranged as an inclined plane.

Further, the vehicle body door frame is provided with an extension portion extending towards the side of the door body along the longitudinal direction of the vehicle.

Further, a sealing rubber is arranged between the extension portion and the door body.

The linear sliding plug movement track adopted in the prior art does not satisfy the required stroke need, as the outer surface of the door body 100 is flush with the outer surface of the vehicle body, thereby the following arrangement is adopted.

Further, the driving device comprises an air cylinder assembly and a slideway assembly, the slideway assembly comprises an upper guide rail, an upper pulley sliding on the upper guide rail, a lower guide rail, and a lower pulley sliding on the lower guide rail. The door body is connected to the upper pulley and the lower pulley. The air cylinder assembly drives the upper pulley and the lower pulley to slide.

Further, the upper guide rail and the lower guide rail are arranged to be in an arc-plus-linear shape.

The movement track of the door body is changed into an arc-plus-linear reciprocating motion, due to the design that the guide rail is in an arc-plus-linear shape. The compressing airtight stroke of the door body in a large stroke is realized. The movement stroke required for the outer surface of the door body being flush with the outer surface of the vehicle body is guaranteed.

In order to improve the stability of the door body when the side sliding door is opened and closed, further, the driving device comprises two sets of the slideway assemblies. The pulleys of the two sets of the slideway assemblies are respectively connected to the two sides of the door body.

In summary, the side sliding door of the railway vehicle of the present disclosure has the following advantages:

1. The outer surface of the door body is flush with the outer surface of the vehicle body when the door body is closed, so that there exists no height difference between the vehicle body and the doorway of the side sliding door. Snow accumulation at the doorway under the extreme cold working condition is avoided, and then the risk of a door body being frozen is reduced.

2. The movement track of the door body is changed into an arc-plus-linear reciprocating motion, due to the design that the guide rail is in an arc-plus-linear shape. The compressing airtight stroke of the door body in a large stroke is realized. The required movement stroke due to the change of the structure of the door body is guaranteed.

3. The improvement and match of the structures of the door body and the vehicle body door frame not only ensure that the outer surface of the door body is flush with the outer surface of the vehicle body after the door body is closed, but also solve the technical problem that the door body and the door frame abuts against with each other and cannot move due to the change of the movement track of the door body.

4. The double guide rail is adopted, so that the hanging structure of the door body and the pulley has a greater axial rigidity. The opening stability of the vehicle door during the extreme cold operation is realized.

BRIEF DESCRIPTION OF THE DRAWINGS

As shown in FIG. 1 to FIG. 4, door body 100, outward convex portion 101, door body side surface 102, vehicle body door frame 200, side surface of vehicle body door frame 201, extension portion 202, sealing rubber 300, air cylinder assembly 400, slideway assembly 500, upper guide rail 501, upper pulley 502, lower guide rail 503, lower pulley 504, upper door leaf carrier 505, lower door leaf carrier 506.

DETAILED DESCRIPTION

The following is further described in details with the present disclosure with accompanying drawings and embodiments.

Figure 1:
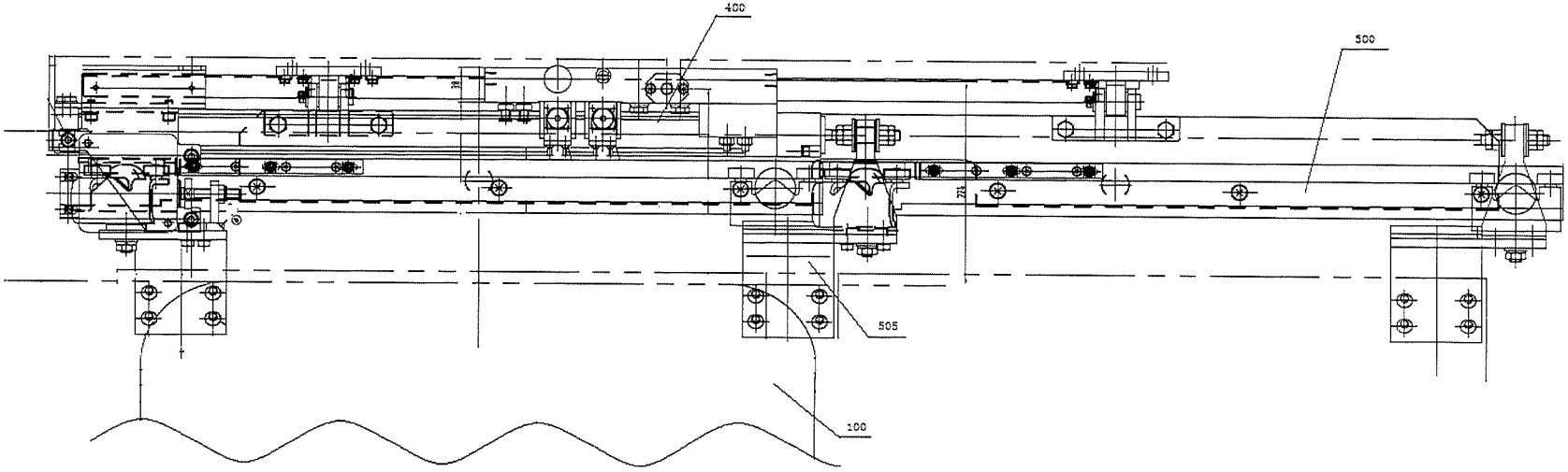
FIG. 1 is a structural schematic diagram of the vehicle of the present disclosure in a front view from the inside of a vehicle.
Figure 2:
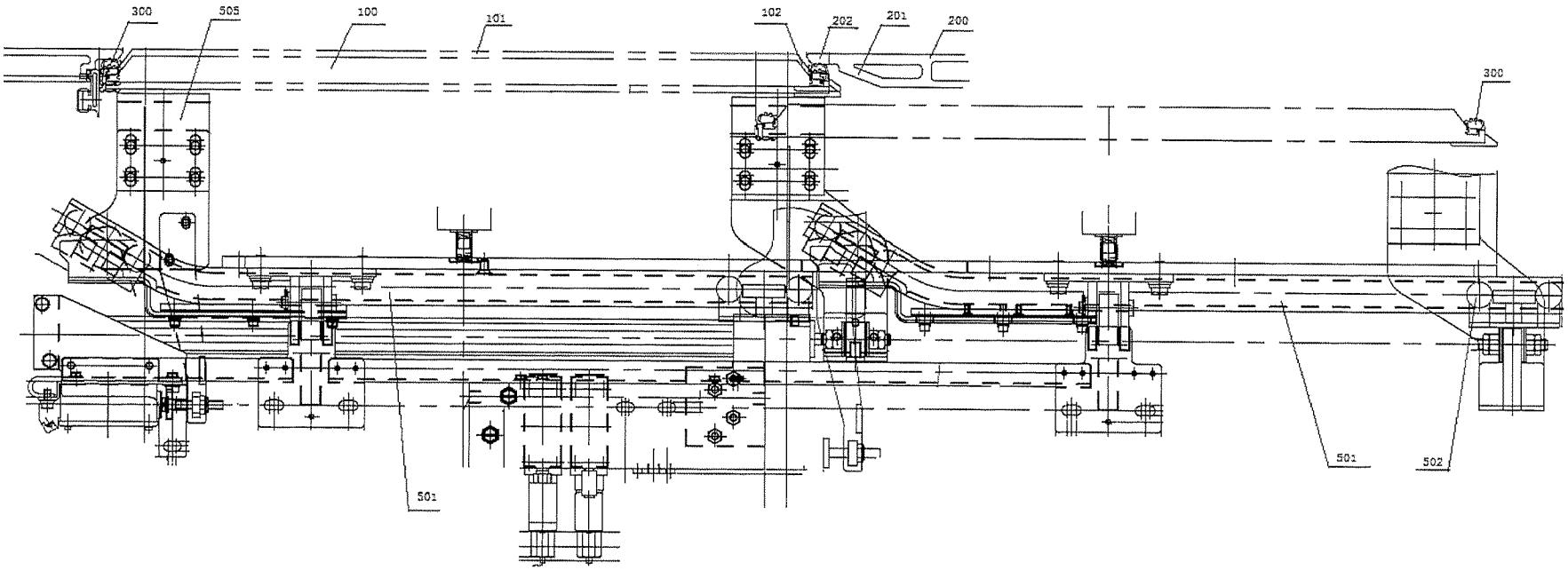
FIG. 2 is a structural schematic diagram of the vehicle of the present disclosure in a plan view.
Figure 3:
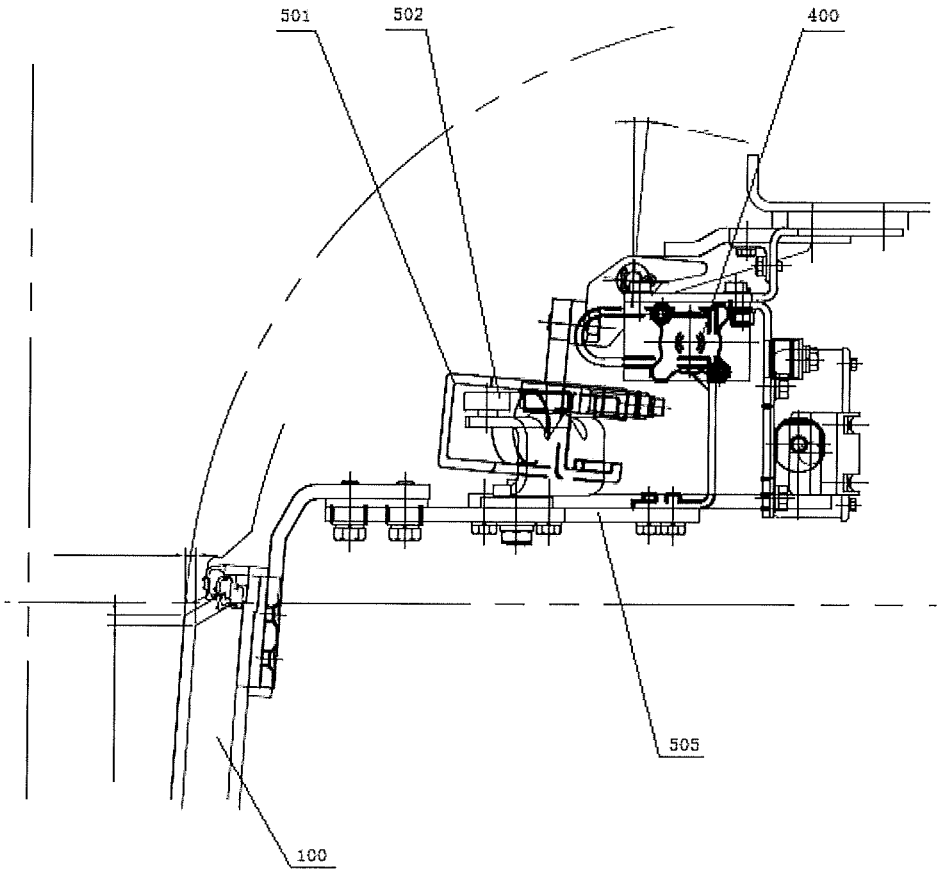
FIG. 3 is a side view of a top of the door body of the present disclosure.
Figure 4:
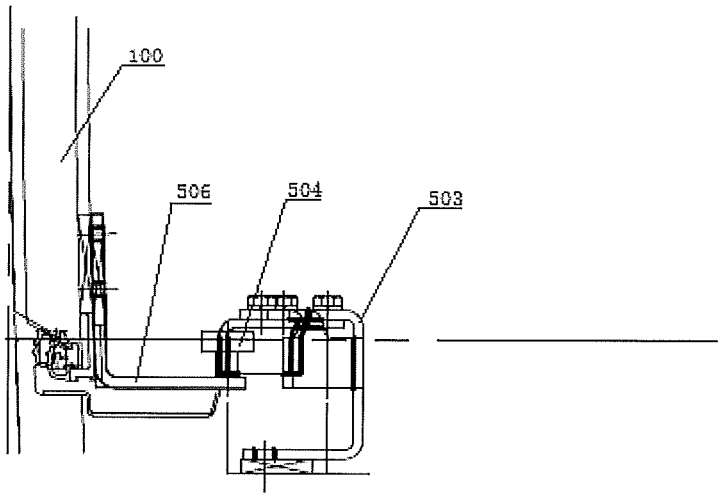
FIG. 4 is a side view of a bottom of the door body of the present disclosure.

For sake of easy understanding, 'along the longitudinal direction of the vehicle body' and 'axial direction' described in the present specification refer to the up-down direction in FIG. 1 or FIG. 2. 'Along the width direction of the vehicle body' refers to the left-right direction in FIG. 1 or FIG. 2.

Embodiment 1

A side sliding door of a railway vehicle, provided by the present disclosure, is applied to a vehicle working under extreme cold weather, which is designed to prevent a vehicle door from freezing and ensures normal operation of the vehicle.

The side sliding door of the railway vehicle mainly comprises a door body 100, a vehicle body door frame 200, and a driving device of the door body. The door body 100 can be pulled and pushed to perform repetitive movement, realizing the opening and closing of a vehicle door. The vehicle body door frame 200 is arranged around the periphery of the door body 100, and is welded and fixed to a vehicle body framework. The driving device of the door body is mainly used to drive the door body 100 for opening and closing.

In the present embodiment, an outer surface of the door body 100 is flush with an outer surface of the vehicle body when the door body 100 is closed. In order to increase the aesthetics, a curvature of the outer surface of the door body 100 and the vehicle body is matched with each other, to be a planar structure from the outside of the vehicle.

The outer surface of the door body 100 is flush with the outer surface of the vehicle body when the door body 100 is closed, so that there exists no height difference between the vehicle body and a doorway of the side sliding door. Snow accumulation at the doorway under the super cold working conditions is avoided, and then the risk of a door body being frozen is reduced.

Embodiment 2

As shown in FIG. 1 to FIG. 4, the door body 100 is provided with an outward convex portion 101. The outward convex portion 101 extends towards the outside of the vehicle, and the shape of the outward convex portion 101 conforms to the shape of the vehicle body door frame 200. The outward convex portion 101 protrudes into the vehicle body door frame 200 when the door body 100 is closed, and an outer surface of the outward convex portion 101 is flush with the outer surface of the vehicle body.

The length of the outer surface of the outward convex portion 101 along the longitudinal direction of the vehicle body is shorter than the length of the inner surface of the door body 100 along the longitudinal direction of the vehicle body, and an inclined surface is formed on a side surface of the outward convex portion 101.

The door body 100 and the outward convex portion 101 form a stepped structure. A door body side surface 102 forms a combination of an inclined surface, a flat surface and an inclined surface.

The length of an outer surface is longer than the length of the inner surface of the vehicle body door frame 200 along the longitudinal direction of the vehicle body, and a side surface of vehicle body door frame 201 is arranged as an inclined plane.

The vehicle body door frame 200 is provided with an extension portion 202. The extension portion 202 extends towards the side of the door body along the longitudinal direction of the vehicle body. There is a less gap between the extension portion 202 and the door body 100 along the longitudinal direction of the vehicle body.

A sealing rubber 300 is arranged between the extension portion 202 and the door body 100. The sealing rubber 300 is specifically arranged between the extension portion 202 and the flat surface of the door body side surface 102. A fixing groove is arranged on the flat surface of the door body side surface 102, and the sealing rubber 300 is fixed inside the fixing groove. When the door body 100 is closed, the sealing of the door body 100 and the vehicle body is realized by the compression of the sealing rubber 300.

The door body 100 and the vehicle body door frame 200 are both subject to structure improvement. With the structure improvements adapted with each other, the outer surface of the door body 100 is flush with the outer surface of the vehicle body door frame 200 when the door body 100 is closed.

Embodiment 3

The side sliding door adopts a built-in electric-controlled pneumatic structure. The side sliding door further comprises a pneumatic locking device and a driving device. The pneumatic locking device is used for the compressing and sealing of the side sliding door, and the driving device is used for the opening and closing of the side sliding door.

After the compressed air is input into the air pressure pipeline, the air pressure is controlled by an electromagnetic valve according to the signal provided by a control system, to realize the air supplying for or air exhausting of the driving device and the pneumatic locking device. The opening and closing, and compressing action of the side sliding door is eventually realized.

The driving device is arranged at the top and the bottom of the door body 100. The driving device comprises an air cylinder assembly 400 and a slideway assembly 500. The slideway assembly 500 comprises an upper guide rail 501, a lower guide rail 503, an upper pulley 502 and a lower pulley 504, wherein the upper pulley 502 and the lower pulley 504 slides on the upper guide rail 501 and the lower guide rail 503, respectively.

An upper door leaf carrier 505 and a lower door leaf carrier 506 are fixed and arranged in the door body 100, and extend towards the inner side of the carriage. The upper pulley 502 is fixed with the upper door leaf carrier 505, and the lower pulley 504 is fixed with the lower door leaf carrier 506.

The air cylinder assembly 400 comprises a driving air cylinder arranged at the top of the door body 100. A driving rod of the driving air cylinder is fixed with the upper door leaf carrier 505. The driving air cylinder has a certain degree of lateral freedom to realize the sliding plug movement. The upper pulley 502 slides on the upper guide rail 501 via the force of air cylinder along the axial direction and provided by driving air cylinder, then further drives the door body 100 and the lower pulley 504 to move. Thus, the opening and closing of the door body 100 is realized.

The linear sliding plug movement track adopted in the prior art does not satisfy the required stroke need, because the outer surface of the door body 100 is flush with the outer surface of the vehicle body. In the present embodiment, the upper guide rail 501 and the lower guide rail 503 are arranged in an arc-plus-linear shape. The arc section is close to the doorway, and the linear section is far from the doorway. Then the sliding plug movement track of the door body 100 also becomes the arc-plus-linear reciprocating motion.

The problem that the door body 100 and the vehicle body door frame 200 abuts against each other caused by the change of the arc-shaped movement track of the front section of the door body 100 is effectively solved by improving the cooperation between the door body side surface 102 and the side surface of vehicle body door frame 201.

The movement track of the door body 100 is changed into an arc-plus-linear reciprocating motion, due to the design that the guide rail is in an arc-plus-linear shape. The compressing airtight stroke of the door body 100 in a large stroke range is realized. The movement stroke required for the outer surface of the door body being flush with the outer surface of the vehicle body is guaranteed.

Embodiment 4

In the present embodiment, the driving device is provided with two sets of slideway assemblies 500 and one set of air cylinder assembly 400 to improve the stability of the door body during the opening and closing of the side sliding door. The structure of each slideway assembly 500 is the same as that of embodiment 3.

Two upper guide rails 501 and two lower guide rails 503 are arranged side by side along the longitudinal direction of the vehicle body. Two upper door leaf carriers 505 and two lower door leaf carriers 506 are respectively fixed on the two sides of the door body 100.

The double guide rail structure is adopted, so that the hanging structure of the door body and the pulley has a greater axial rigidity. The opening stability of the vehicle door during the extreme cold weather is realized.

Embodiment 5

In the present embodiment, the driving air cylinder adopts a direct-acting double-stroke air cylinder in order to prevent the accident of crushing and hurting people. Two pistons with different diameters are arranged inside the air cylinder to control the closing force in different stages, to ensure that the closing force in the end stroke of the side sliding door is no more than 177N.

Embodiment 6

The pneumatic locking device comprises a compressing air cylinder. An output end of the compressing air cylinder is connected to an end of a compressing lever which can radially rotate, and the other end of the compressing lever is located in the inner side of the door body 100.

The compressing lever is pushed to rotate after the compressed air is input to the pneumatic locking device. The end portion of the compressing lever near the inner side of the door body is tightly pressed against the door body 100, thereby pushing the airtight rubber of the door body 100 to be tightly compressed against the vehicle body. The good sealing is realized. The reaction force point of a door body acts on the compressing lever on the condition near a lock point, after being compressed in place. Sufficient compressing force is ensured, that is, continuous airtight state is ensured.

The side sliding door further comprises a reset adjusting device. The replacement adjusting device comprises a reset spring arranged between the vehicle body and the door leaf carrier.

The door body 100 is firstly reset when the compressing air cylinder of the pneumatic locking device is released, then the door is opened.

The door body 100 can be restored to a slidable position in time via the reset spring.

A drainage assembly which comprises a water baffle at the outer side and a drain tank at the bottom is arranged at the bottom of the door body 100. A filter screen is arranged inside the drain tank and the drain tank is connected downward to a drainage pipe under the vehicle.

The framework of the vehicle body is provided with an isolation lock. A bolt of the isolation lock is arranged corresponding to a lock hole of the door body 100.

Embodiment 7

A door pillar structure of the built-in side sliding door comprises a door pillar and a door pillar located at two sides of the side sliding door, a doorsill located below the side sliding door and a keeper of the side sliding door in the moving direction. The doorsill is welded and fixed to an underbed of vehicle body. In the present embodiment, the door pillar, the door pillar and the keeper all adopt aluminum alloy profiles made by one-off extrusion formation, in order to improve the vertical stiffness of the door pillar, the door pillar and the keeper. Profiles with different cross sections are adopted according to the different load bearing situations of the door pillar, the door pillar and the keeper.

Wherein, the door pillar is located at the front end of door closing direction of the side sliding door, and adopts an aluminum alloy profile with L-shaped cross section. One side of the door pillar is welded and fixedly connected with a side wall board, and the bottom of the door pillar is welded and fixedly connected with the doorsill. The door pillar is provided with a plurality of reinforcing plates, in order to improve the overall rigidity and strength of the door pillar. The reinforcing plate adopts a U-shaped aluminum alloy profile. In the present embodiment, three reinforcing plates are provided in total.

The door pillar is located at the rear end of the door closing direction of the side sliding door. The requirement for the rigidity of the door pillar here is relatively high, as the door pillar here needs to bear a large force during the door opening or door closing process of the side sliding door. Therefore, in the present embodiment, the door pillar adopts an aluminum alloy profile with a hollow square-shaped cross section. The top of the door pillar is welded and fixedly connected with a vehicle top board, and the bottom of the door pillar is welded and fixedly connected with the doorsill. In the present embodiment, in order to further increase the strength of the door pillar, the door pillar and the vehicle top board are fixedly connected through a connecting plate, one end of the connecting plate is welded and fixed with the top end of the door pillar, and another end of the connecting plate is welded and fixed with the vehicle top board.

Certainly, the door pillar can also be used as the door pillar at the rear end of the door closing direction of the side sliding door, and the door pillar can also be used as the door pillar at the front end of the door closing direction of the side sliding door.

The keeper is located at the far end of the door opening direction of the side sliding door, playing a role in the limiting of moving distance of the side sliding door. In the present embodiment, in order to improve the rigidity of the keeper, the keeper also adopts the aluminum alloy profile with L-shaped cross section, one side of the keeper is welded and fixedly connected with the side wall board. The keeper is provided with two mounting bases of door-in-place responding device, in order to detect whether or not the door opening action of the side sliding door is in place. The responding device can detect whether or not the side sliding door is opened to the designed position, and transmit the relevant signal, as one of the important data for the control of the side sliding door, to the vehicle control system. The operation of the vehicle and the safety of passenger are ensured.

The built-in side sliding door needs the compressing air cylinder to guarantee the air tightness and safety of the side sliding door in a closed state. Three fixing bases for the fixation of the compressing air cylinder of the side sliding door are welded and fixed to the doorway flat surface of the door pillar and the door pillar, in order to improve the air tightness of the side sliding door in a closed state. The fixing base is provided with mounting holes for the installation of the air cylinder.

Embodiment 8

A sidewall assembly suitable for the installation of the side sliding door is provided.

The sidewall assembly is a complete structure composed of five aluminum alloy extruded profiles via welding method, and the sidewall assembly is provided with mounting openings for vehicle accessories such as a side window, a destination display and a fresh air vent. The aluminum alloy extruded profile is a long whole profile formed by extrusion, and is of hollow truss structure with thin wall and inner ribs. Adjacent profiles are connected via insertion and welding method.

Two adjacent aluminum alloy extruded profiles are respectively provided with a groove at the joint, and the two grooves form a V-shaped welding groove. The inner side of the joint is provided with an underboarding formed on any one of the aluminum alloy extruded profiles. The underboarding is parallel to the board surface of the aluminum alloy extruded profile, the cross section of the underboarding is in a hook-shape, the head portion of the underboarding is in a V-shape with a rounded transition at the top corner. The underboarding is inserted into the slot of another aluminum alloy extruded profile when assembled. The outer side of the hook portion is a short plane, and the short plane is clinging to the inner wall of the joint of another aluminum alloy extruded profile. A hook groove between the root portion and the head portion forms a cavity corresponding to the joint.

The underboarding forms a tenon portion for the mutual insertion of the aluminum alloy extruded profiles. The hook-shape not only makes the underboarding easier to be inserted into the slot, but also allows a large elastic margin in the width direction, and allows higher connection strength and stability after the insertion.

On the other hand, the cavity formed by the hook groove between the head portion and the root portion of the underboarding plays a role in separation, so that the underboarding is not directly in contact with the welding part. The local thermal conduction is effectively blocked. It is not easier for the insertion portion to be deformed by the heat during the welding. Moreover, the cavity allows the welding portion to inwardly protrude, and accommodates part of solder. Then the welding precision and strength is ensured.

The underboarding at the inner and outer joint can be located on the same aluminum alloy extruded profile, and can also be respectively located on two aluminum alloy extruded profiles.

At the mounting openings for accessories, reinforcing ribs for reinforcement are arranged at the upper edge and the lower edge of a side window opening. A transverse rib is integrally extruding deformed with the aluminum profile, perpendicular to the outer facade and inner facade of the aluminum profile. Wherein, the periphery of the opening of the outer facade exceeds the transverse rib by a certain distance. The size of the formed opening of the outer facade is smaller than that of the opening of the inner facade.

In this way, the outer facade and inner facade at the upper edge and the lower edge of the side window opening is no longer supported by oblique inner ribs inside the profiles, and can also be supported by the transverse rib at the same time; therefore, the structure strength is improved. The transverse rib can form a flat mounting portion, and can improve the stability of the side window after being installed.

A display is installed in a display opening of the side wall assembly. An upper edge and lower edge of an inner side of the opening are respectively provided with a chute extending along the longitudinal direction of the vehicle. The chute is integrally extruding deformed with the aluminum profile. The part of the main body of the display is embedded in the display opening. The upper edge and the lower edge of the back portion are respectively fixed in the chute through Z-shaped bracket and bolt assembly. The specific fixing method is that head of the bolt is clipped into the chute, and threaded rod protrudes from the chute opening and is blocked with a nut through the Z-shaped bracket.

Besides the chute for the installation of the destination display, the inner wall of the side wall is also provided with a plurality of chutes for the installation of other vehicle accessories at different heights. The structure of the side wall with chute can well meet the installation needs of the internal components, improving the overall modularity.

The doorway of the side sliding door is integrally processed by the CNC machining center and is welded with the pillar to be a whole. As it is one-off integral processing and deformation, the accuracy of the structure can be ensured. Subsequently stress concentration dispersion block is added at four corners of the side door to optimize the structure and avoid stress concentration. Another longitudinal rectangular opening is arranged at the lower right side of the doorway zone, for installing the emergency unlocking device. The need for installation and usage of the emergency unlocking device is met.

The pillar of the side door is directly provided with the mounting holes for the door mechanism and the inner components. The mounting holes are specifically transverse and longitudinal long-round holes, to meet the installation need for outwardly hanging of the side sliding door and inwardly mounting of the cover board. This pre-opening-holes method can greatly reduce the welding workload and has good processability.

In addition, the shape of the cross section of the side wall can be further optimized, to improve the strength and rigidity, and the need for the side window and the destination display mounting hole is met.

Specifically, in the cross section, the width of the side wall gradually increases along the inner side from the middle portion to the lower portion. There does not exist stress concentration phenomenon, comparing with the transverse section with abrupt widening. The variable section is designed for the weak portion, after the simulation calculation, the wall thickness of the profile is optimized, so that the width of the portion above the lower edge is designed to be larger, the structure strength of the portion above the lower edge is higher.

The above-described embodiments are merely illustrative of the preferred solutions of the present disclosure and are not limited thereto. On this basis, targeted adjustments can be made according to the actual needs, thereby obtaining different implementation solutions. For example, the cross section of the underboarding at the inner side of the joint can be designed to be in a shape of others like a hook, or, the number of the aluminum alloy extruded profile can further increase or decrease. As there are many ways to implement, here is no longer an example.

As described above, a similar technical solution can be derived in combination with the presented solution content by the accompanying drawings. But any and all modifications, equivalents, and modifications of the foregoing embodiments are within the scope of the present disclosure without departing from the spirit of the technical solution of the present disclosure in accordance with the technical details of the present disclosure.

The invention claimed is:

1. A side sliding door of a railway vehicle, comprising a door body and a driving device for an opening and closing of a doorway, wherein, an outer surface of the door body is flush with an outer surface of a vehicle body when the door body is closed, a movement track of the door body is an arc-plus-linear reciprocating motion, the driving device comprises an air cylinder assembly and a slideway assembly, the slideway assembly comprises an upper guide rail, an upper pulley sliding on the upper guide rail, a lower guide rail, and a lower pulley sliding on the lower guide rail, the door body is connected to the upper pulley and the lower pulley, the air cylinder assembly drives the upper pulley and the lower pulley to slide;

an upper door leaf carrier and a lower door leaf carrier are fixed and arranged in the door body, the upper door leaf carrier and the lower door leaf carrier extend towards an inner side, the upper pulley is fixed with the upper door leaf carrier, and the lower pulley is fixed with the lower door leaf carrier, and the air cylinder assembly comprises a driving air cylinder arranged at a top of the door body, a driving rod of the driving air cylinder is fixed with the upper door leaf carrier, the driving air cylinder has a certain degree of lateral freedom to realize a sliding plug movement.

2. The side sliding door of the railway vehicle according to claim 1, wherein, an outward convex portion extending towards an outside of the vehicle is provided on the door body, a length of an outer surface of the outward convex portion along a longitudinal direction of the vehicle is shorter than a length of an inner surface of the door body along the longitudinal direction of the vehicle.

3. The side sliding door of the railway vehicle according to claim 2, wherein, the door body and the outward convex portion form a stepped structure, a side surface of the door body is a combination of a first inclined surface, a flat surface and a second inclined surface.

4. The side sliding door of the railway vehicle according to claim 2, wherein, a vehicle body door frame is arranged around a periphery of the door body, a length of an outer surface of the vehicle body door frame along the longitudinal direction of the vehicle is longer than a length of an inner surface of the vehicle body door frame along the longitudinal direction of the vehicle.

5. The side sliding door of the railway vehicle according to claim 4, wherein, a side surface of the vehicle body door frame is an inclined plane.

6. The side sliding door of the railway vehicle according to claim 4, wherein, the vehicle body door frame is provided with an extension portion extending towards a side of the door body along the longitudinal direction of the vehicle.

7. The side sliding door of the railway vehicle according to claim 6, wherein, a sealing rubber is arranged between the extension portion and the door body.

8. The side sliding door of the railway vehicle according to claim 1, wherein, the upper guide rail and the lower guide rail are in an arc-plus-linear shape.

9. The side sliding door of the railway vehicle according to claim 1, wherein, the driving device comprises two sets of the slideway assemblies, the pulleys of the two sets of the slideway assemblies are respectively connected to two sides of the door body.

10. The side sliding door of the railway vehicle according to claim 3, wherein, a vehicle body door frame is arranged around a periphery of the door body, a length of an outer surface of the vehicle body door frame along the longitudinal direction of the vehicle is longer than a length of an inner surface of the vehicle body door frame along the longitudinal direction of the vehicle.

11. The side sliding door of the railway vehicle according to claim 1, further comprising a reset adjusting device, the reset adjusting device comprising a reset spring arranged between the vehicle body and the door leaf carrier.

* * * * *